United States Patent [19]

Hoekje et al.

[11] 3,990,957

[45] Nov. 9, 1976

[54] METHOD OF ELECTROLYSIS

[75] Inventors: Howard H. Hoekje, Akron; Harlan B. Johnson, Rittman; Ronald D. Chamberlin, Wadsworth, all of Ohio

[73] Assignee: PPG Industries, Inc., Pittsburgh, Pa.

[22] Filed: Nov. 17, 1975

[21] Appl. No.: 632,532

[52] U.S. Cl. ..... 204/128; 204/129; 204/290 R; 204/291

[51] Int. Cl.[2] ..... C25B 1/02; C25B 11/04

[58] Field of Search ..... 204/98, 128, 129, 290 R, 204/290 F, 291, 292

[56] References Cited

UNITED STATES PATENTS

| | | | |
|---|---|---|---|
| 3,711,397 | 1/1973 | Martinsons | 204/291 |
| 3,852,175 | 12/1974 | Hoekje | 204/98 |
| 3,945,907 | 3/1976 | Gokhale | 204/290 R |

*Primary Examiner*—Donald L. Walton
*Attorney, Agent, or Firm*—Richard M. Goldman

[57] ABSTRACT

Disclosed is a method of electrolyzing an aqueous alkali metal chloride, which method comprises passing an electrolytic current from an anode of an electrolytic cell through an alkali metal chloride electrolyte to a cathode of the cell, evolving chlorine at the anode and hydrogen at the cathode. The method is characterized by the use of a cathode having a layer of an oxy-compound of a platinum group metal and an alkaline earth metal on an electroconductive cathode substrate.

14 Claims, No Drawings

METHOD OF ELECTROLYSIS

DESCRIPTION OF THE INVENTION

This invention relates to a method of electrolysis, an electrode useful in the electrolysis and, more particularly, to a cathode for the electrolysis of alkali metal chloride solutions in the production of chlorine, alkali metal hydroxide, and hydrogen.

The commercial electrolysis of aqueous alkali metal chloride solution, such as sodium chloride brines and potassium chloride brines, may be carried out in electrolytic cells having an anode and a cathode immersed in an aqueous electrolyte containing sodium chloride or potassium chloride. Typically, when the reaction is carried out to produce elemental chlorine and alkali metal hydroxide in a diaphragm cell, the cell is divided into two compartments, an anode compartment and a cathode compartment, separated by a permeable barrier. The cathode is typically of perforate or foraminous metal and a diaphragm is in contact therewith.

The anode may be a sheet, plate, rods, or the like, fabricated of valve metal and having a suitable electrocatalytic coating thereon. By a valve metal is meant a metal that forms an oxide film when exposed to acidic materials under anodic conditions. The valve metals include titanium, tungsten, zirconium, columbium, hafnium, and tantalum. Most commonly, titanium, tantalum, or tungsten is used to provide the valve metal substrate. Alternatively, the anode substrate may be provided by silicon with a suitable electrocatalytic coating thereon.

Typically, in the electrolytic cells of the prior art, the cathode has been provided by a steel or iron member, fabricated, for example, of perforated plate, metal mesh, expanded metal mesh, or the like.

A permeable barrier or multiple permeable barriers separate the anolyte compartment, that is, the compartment containing the anode and the electrolyte in contact therewith from the catholyte compartment, that is, compartment containing the cathode and the electrolyte in contact therewith. Typically, the permeable barrier is on the cathode although it may be spaced between the anode and the cathode, or there may even be one permeable barrier on an anode and one on a cathode with an electrolyte compartment between the permeable barriers.

Typically, the permeable barrier is provided by fibrous asbestos, deposited on the cathode by methods well known in the prior art. However, the permeable barrier may also be provided by asbestos paper or by asbestos treated with an inorganic reinforcing agent or by an organic reinforcing agent as is well known in the prior art. For example, the reinforcing agent may be an organic polymer, such as a fluorocarbon polymer, or a chlorofluorocarbon polymer. Additionally, the polymer may have active groups such as acid groups thereon. Alternatively, the barrier or barriers may be a permionic membrane, fabricated, for example, of organic polymers such as halocarbons. The halocarbon may be a fluorocarbon or a chlorofluorocarbon, having active groups thereon, such as sulfonic acid groups, phosphorous acid groups, phosphonic acid groups, carboxylic acid groups, and the like.

In the method of electrolysis of an alkali metal chloride brine in a diaphragm cell to produce chlorine, alkali metal hydroxide, and hydrogen, an aqueous solution of the alkali metal chloride, i.e., a brine, is fed into the anolyte chamber of the cell. An electrolytic current is passed from the anode through the electrolyte to the cathode, that is, the electrolytic current passes from the anode through the anolyte liquor to the permeable barrier and through the permeable barrier to the catholyte liquor and the cathode. Where there are a plurality of permeable barriers with separate electrolytes therebetween, the electrolytic current passes from the anode through the intervening electrolytes and permeable barriers to the cathode. Chlorine is evolved at the anode, hydrogen is evolved at the cathode, and an alkali metal hydroxide solution formed in the catholyte liquor. Chlorine is then collected from the anolyte chamber and hydrogen and the alkali metal hydroxide collected from the catholyte chamber.

The anode reaction is reported to be $$2Cl^- \rightarrow Cl_2 + 2e^- \qquad 1.$$

The overall cathode reaction is reported to be $$2H_2O + 2e^- \rightarrow H_2 + 2OH^- \qquad 2.$$

which is actually reported to be the product of two reactions, the first reaction being $$H_2O + c^- \rightleftarrows H_{(ads)} + OH^- \qquad 3.$$

and the second step is reported to be either $$2H_{(ads)} \rightarrow H_2 \qquad 4.$$

or $$H_{(ads)} + H_2O + c^- \rightarrow H_2 + OH^- \qquad 5.$$

Postulated mechanisms (3) – (4) and (3) – (5) both involve the adsorption of hydrogen onto the surface of the cathode and the subsequent desorption of the hydrogen to form diatomic hydrogen molecules. The hydrogen molecule evolution reaction, that is, the desorption of an adsorbed hydrogen, as in either desorption (4) or desorption (5), is believed to be the rate controlling step, that is, it is believed to be the overvoltage determining step.

It has now been found that the presence of the surface of the cathode of a class of compounds reduces the cathodic overvoltage of hydrogen evolution in strongly basic aqueous media. The class of compounds is the oxy-compounds of platinum group metals and alkaline earth metals.

DETAILED DESCRIPTION OF THE INVENTION

The present invention provides a method of electrolyzing an aqueous alkali metal chloride solution comprising passing an electrolytic current from an anode of an electrolytic cell through the alkali metal chloride electrolyte to a cathode of the electrolytic cell, thereby evolving chlorine at the anode and hydrogen at the cathode. The method of this invention is directed to the improvement wherein the cathode has a layer of an oxy-compound of a platinum group metal and an alkaline earth metal on an electroconductive substrate. In this way, a chlor-alkali cell cathode is provided having a hydrogen overvoltage of below about 0.1 volt in basic media at a current density of 100 amperes per square foot.

By an oxy-compound is meant an oxygen-containing compound of two or more metals, which compound has the general formula;

$M^{I}_{x}M^{II}_{y}O_{z}$ where I and II designate different metals and $x$, $y$, and $z$ are stoichiometric coefficients. An oxy-compound as defined above is to be distinguished from a mixture of two oxygen-containing compounds, one having the formula $M^{I}_{s}O_{t}$ and $M^{II}_{u}O_{v}$.

Included within the scope of the present invention are electroconductive oxy-compounds of alkaline earth metals and platinum group metals including ruthenium, osmium, rhodium, palladium, iridium, and platinum, such as the ruthenates, ruthenites, osmiates, osmites, rhodenates, palladates, iridenates, and platinates of calcium, strontium, barium, and magnesium. Oxy-compounds of alkaline earth metals and platinum group metals would especially include such oxy-compounds as calcium iridiate, strontium iridiate, calcium rhodate, strontium rhodite, and strontium platinite. The oxy-compound may include mixed alkaline earth metals and platinum group metals, for example, $(M_{Ia}^{x}\ M_{Ib}^{1-x})(M_{IIa}^{y}\ M_{IIb}^{1-y})O_{z}$, where $M^{Ia}$ is either strontium or calcium, $M^{Ib}$ is magnesium, calcium, or strontium, $M^{IIa}$ and $M^{IIb}$ are platinum group metals, x is from O to 1, y is from O to 1, z is between 3 and 4.

The oxy-compound could include an alkaline earth metal, a platinum group metal, and a transition metal, such as $M^{I}(M_{II\ y}M_{III}^{1-y})O_{z}$ where $M^{III}$ is titanium, tantalum, tungsten, iron, cobalt, nickel, or magnesium, $M^{I}$ is an alkaline earth metal, $M^{II}$ is a platinum group metal, and $y$ and $z$ are as defined above. In certain circumstances, particularly when platinum is present in the oxy-compound, care must be taken to avoid reducing the platinum group metal in the compound to the elemental platinum group metal.

While the coating is principally comprised of the oxy-compound of the alkaline earth metal and the platinum group metal, it may include some mixed oxides of the platinum group metal and the alkaline earth metal as well as the elemental platinum group metal. Additionally, it is to be understood that the coating may contain various alkali-resistant materials to bond the oxy-compound to the surface of the cathode, for example, alkali resistant refractory type oxides, such as oxides of iron, cobalt, nickel, titanium, zirconium, hafnium, and columbium.

According to one exemplification of this invention, the platinum group metal is chosen from the group consisting of the perovskite-forming platinum group metals. These are identified in the literature as ruthenium, osmium, and mixtures thereof. According to this preferred exemplification of the invention, the alkaline earth metal is chosen from the group consisting of magnesium, calcium, strontium, barium, and mixtures thereof.

The preferred oxy-compounds are those identified in the literature as magnesium ruthenate ($MgRuO_4$), magnesium ruthenite ($MgRuO_3$), calcium ruthenate ($CaRuO_4$), calcium ruthenite ($CaRuO_3$), strontium ruthenate ($SrRuO_4$), strontium ruthenite ($SrRuO_3$), barium ruthenate ($BaRuO_4$), barium ruthenite ($BaRuO_3$), and mixtures thereof, such as magnesium-calcium ruthenate, magnesium-calcium ruthenite, magnesium-strontium ruthenate, magnesium-strontium ruthenite, magnesium-barium ruthenate, magnesium-barium ruthenite, calcium-strontium ruthenate, calcium-strontium ruthenite, calcium-barium ruthenate, calcium-barium ruthenite, strontium-barium ruthenate, strontium-barium ruthenite, magnesium ruthenate-magnesium ruthenite, calcium ruthenate-calcium ruthenate, strontium ruthenate-strontium ruthenite, barium ruthenate-barium ruthenite, and the analogous compounds of osmium.

The preferred oxy-compounds are oxy-compounds of Ru(+4), Ru(+6), Os(+4), Os(+6), and mixtures thereof having a perovskite or distorted perovskite crystal structure. This may be evidenced by a perovskite-type x-ray diffraction pattern.

For example, $SrRuO_3$ is reported to have perovskite structure ($a = 3.93$ A); $BaRuO_3$ is reported to have a distorted perovskite structure of a rhombohedral lattice in which $BaO_3$ layers are stacked and the ruthenium has slightly distorted octahedral coordination such that there are strings of three face-sharing $RuO_6$ octahedra, the strings being linked by the sharing of corners. Furthermore, in the $BaRuO_3$ lattice, the ruthenium-ruthenium distance is reported to be only 2.55 $\pm$ 0.01 A., suggesting metal-metal interaction.

The perovskite crystal structure and the methods of identifying it by x-ray techniques are described in the literature. For example, the perovskite structure is discussed in Evans, *An Introduction to Crystal Chemistry*, (2nd Edition), Cambridge University Press, New York (1966) at pages 167-170; in Bragg, Claringbull and Taylor, *The Crystalline State*, Volume 4: *Crystal Structure of Minerals*, G. Bell & Sons Ltd., London, (1965) at pages 100–102; in Wyckoff, *Crystal Structure*, Volume 2, (2nd Edition), Wiley & Sons, New York (1964) at pages 390-402; in Wells, *Structural Inorganic Chemistry*, Oxford University Press, New York (1950) at pages 89-92, and pages 494-502; by Donohue, Katz, and Ward, in *Inorganic Chemistry*, Volume 4, page 306, (1965); and by Khanolkar in *Current Science* (*India*), Volume 30, page 52, (1961).

The substrate of the cathodes used in the method of this invention is typically fabricated of those metals useful in forming chlor-alkali cell cathodes, for example, iron and alloys of iron such as low carbon steel. Preferably, the substrate is in the form of a perforated plate, or expanded metal mesh, or rods, or bars, or the like. However, the substrate of this invention may also be iron shot or graphite shot or the like.

Typically, the cathode has a coating that is intermediate to the oxy-compound layer described and the iron or steel of the substrate of the cell. This intermediate coating reduces or even prevents oxidation of the substrate during in situ formation of the oxy-compound. That is, when the oxy-compound of the platinum group metal and the alkaline earth metal is formed in situ on the surface of the cathode substrate, the cathode substrate has a layer of a material that is resistant to oxidation during the in situ formation of the oxy-compound.

Typically, the oxidation resistant material on the surface of the substrate is a layer of nickel that is thick enough to prevent oxidation of the iron substrate during the in situ formation of the oxy-compound. A satisfactory layer is one having a thickness of from about 5 to about 1000 micro inches.

Where the physical form of the cathode is sheet or plate or mesh or bars, it may be capable of supporting a diaphragm or permionic membrane. Alternatively, a support may be provided for the diaphragm or other permeable barrier.

The cathode itself is first prepared by pretreating the iron, such as cleaning and degreasing it, and thereafter applying the protective coating, that is, in a preferred exemplification, a nickel coating. The nickel coating may be provided by electroplating nickel onto the steel, for example, rendering the steel cathodic and electroplating the nickel thereon by methods well known in the art. Typically, the electroplating is continued until the nickel coating is from about 5 to about 1000 micro inches thick. Thereafter, the oxy-compound of the platinum group metal may be prepared by methods well known in the art. Alternatively, the oxide may be provided by thermal decomposition of compounds that yield the oxide on thermal decomposition in air, e.g., nickel chloride, nickel carbonate, nickel nitrate, and organic salts of nickel.

The method of preparing the oxy-compound should be such as to provide an oxy-compound of an alkaline earth metal and ruthenium or osmium having a ratio by mole of 1 atom alkaline earth metal to about 1 of the platinum group metal under conditions sufficient to oxidize or maintain the platinum group metal in the +4 to +6 oxidation state. The platinum group metal, as well as the oxide of the platinum group metal, may be present in finish material as may a limited amount of other impurities without deleterious effect.

The oxy-compound may then be applied. It may, according to one exemplification, be formed in situ. According to an alternative exemplification it may be synthesized and thereafter applied to the cathode.

The coating may, for example, be prepared by the in situ reaction of the precursors on the cathode, e.g., reacting $RuCl_3$, $SrCl_2$, and $TiCl_3$ in suitable solvents on the steel or nickel coated steel surface. According to one exemplification of this invention, a composition prepared from 0.4 gram of $RuCl_3$ may be reacted with 0.435 gram of $SrCl_2$ and 1.24 grams of a 20 weight percent aqueous solution of $TiCl_3$ in the presence of 0.4 gram of a 30 weight percent solution of $H_2O_2$ and 5 grams of ethyl alcohol on a nickel coated steel cathode surface at a temperature of 300° C.–700° C. to provide the cathode herein contemplated. According to an alternative exemplification of this invention a composition prepared from 0.4 gram of $RuCl_3$ may be reacted with 0.435 gram of $SrCl_2$ and 1.94 grams of a 20 weight percent solution of $NiCl_2.6H_2O$, in 5 grams of ethyl alcohol at a temperature of 300° C. to 700° C. on the surface of the cathode.

According to still another exemplification of this invention, equal moles of $RuCl_3.4H_2O$ and $SrCl_2.6H_2O$ may be dissolved in distilled water with a small amount of HCl. Thereafter an excess of oxalic acid may be added to the composition and sufficient $NH_4OH$ to render the solution alkaline. This may be heated to boiling and boiled to dryness. The resulting solid may then be applied to a cathode, e.g., by mixing with $TiCl_3$, or $NiCl_2$, or $TiCl_3$ and $RuCl_3$, or $NiCl_2$ and $RuCl_3$, and applied to a steel substrate and heated to a temperature of 300° C. to 700° C. to obtain the cathode surface herein contemplated.

As noted above, the bonding material, an alkali resistant oxide, may be present with the oxy-compound.

Thus, amorphous titanium dioxide may be present where the oxycompound is bonded to the cathode by crystalline or amorphous titanium dioxide. According to an exemplification where titanium dioxide is present on the surface of the cathode, the platinum group metal oxy-compound is preformed by methods that are well known in the prior art. Thereafter, the oxy-compound may be applied to the cathode substrate by suspending the oxy-compound in a fluid carrier such as titanium resinate or a titanium chloride in an aqueous solution or an alcohol solution and applying the suspension of the oxy-compound of the alkaline earth metal, the platinum compound, and the titanium chloride and removing the fluid carrier as by evaporation.

Alternatively, compounds of the alkaline earth metal, the platinum group metal, and the titanium, may be applied to the nickel coated surface of the cathode and the coating material formed in situ. Typically, when this is carried out, the temperature to which a material is heated should be sufficient to form the oxy-compound of the platinum group metal as well as to form the titanium dioxide.

The cathode, having an alkaline earth metal-platinum group metal oxy-compound surface thereon may thereafter be used as a cathode in a chloralkali electrolytic cell. The cell may have a diaphragm and be intended for the production of chlorine, hydrogen, and alkali metal hydroxide. Or, the anode and the cathode may be in the same electrolyte compartment, as when the intended products are hydrogen and alkali metal chlorates or alkaline earth metal chlorates. In either case the cathodic reaction involves the evolution of hydrogen.

According to the method of this invention, an electrical current is caused to pass from the anode to the cathode, evolving chlorine at the anode and hydrogen at the cathode, and the hydrogen evolution overvoltage of the cathode is reduced relative to the hydrogen evolution overvoltage of a steel cathode. Typically, according to the method of this invention, the hydrogen evolution overvoltage in basic media is below about 0.1 volt at 100 amperes per square foot, frequently as low as 0.08 volt, and even as low as 0.05 volt. The hydrogen overvoltage on conventional steel cathodes in basic media is generally from about 0.25 to 0.28 volt at 100 amperes per square foot. Furthermore, according to the method of this invention, the chlorate content of the catholyte liquor is reduced. The cathode coating described herein may be applied to a steel cathode to reduce the hydrogen evolution overvoltage thereof.

The following example is illustrative.

EXAMPLE

Four cathodes were prepared having strontium ruthenite surfaces on nickel coated steel plate cathodes. The cathode plates were 5 inch by 7 inch perforated steel plates. Each plate was electroplated with nickel from a Watts Bath of nickel sulfate, nickel chloride, and boric acid at a current density of 1.8 amperes per square decimeter.

The strontium ruthenite was prepared by calcining equal moles of ruthenium metal and strontium carbonate at about 1200° C. for in excess of 8 hours. X-Ray analysis showed that strontium ruthenite was formed.

A coating composition was prepared containing 2.80 grams of the dried solid, 6 grams of Englehard Titanium Resinate, 3.25 grams of toluene, and 0.75 gram of phenol. Three coats of the composition were brushed on each nickel plated steel plate to provide a total $SrRuO_3$ concentration of 0.5 gram per square foot. The plates were heated to 350° C. for 25 minutes after each of the first two coats. Cathode 1 was heated to 400° C. for 25 minutes after the last coat, cathode 2 to 450° C. for 25 minutes after the last coat, cathode 3 to 500° C—for 25 minutes after the last coat, and cathode 4 to 550° C. for 25 minutes after the last coat.

Asbestos paper diaphragms of 62 mil thickness were then placed on each of the cathodes and the cathodes were then placed in laboratory diaphragm cells. Each diaphragm cell had a $RuO_2$ coated titanium mesh anode spaced 5 to 6 millimeters from the cathode. Sodium chloride brine containing 314 grams per liter of sodium chloride was fed to each of the cells and electrolysis was carried out at a current density of 100 amperes per square foot.

Over a period of electrolysis of 14 days, the following conditions were observed (100 amperes per square foot).

TABLE I

| Cell Voltages and Cathode Voltages | | | | |
|---|---|---|---|---|
| Cathode No. | 1 | 2 | 3 | 4 |
| Minimum cell voltage | 2.56 | 2.57 | 2.74 | 2.58 |
| Maximum cell voltage | 2.70[1] | 2.70[1] | 2.85[1] | 2.67 |
| Minimum cathode voltage[2] | not measured | | 1.220 | 1.143 |
| Maximum cathode voltage[2] | not measured | | 1.345 | 1.266 |

[1]On start-up
[2]Vs. SCE

Thereafter, the cells were shut down and disassembled. The diaphragms were removed, new diaphragms were placed on cathodes 1 and 2, and cathodes 1 and 2 were again installed in laboratory cells as described above.

A diaphragm of 20 weight percent reconstituted 62 mil asbestos paper deposited atop 62 mil asbestos paper that had previously been heated to above about 110° C. in the substantial absence of water was placed on cathode 1. A diaphragm of 40 weight percent reconstituted 62 mil asbestos paper deposited atop 62 mil asbestos paper that had previously been heated to above about 110° C. in the substantial absence of water was placed on cathode 2. The cells, each having a $RuO_2$ coated titanium anode spaced 5 to 6 millimeters from the cathode, were then assembled.

Sodium chloride brine containing 314 grams per liter of sodium chloride was then fed to the cell and electrolysis commenced. The hydrogen overvoltage on cathode 1 was 0.11 volt and the hydrogen overvoltage on cathode 2 was 0.13 volt. Electrolysis was continued using cathode 1 for 32 days, at which time the hydrogen overvoltage was 0.09 volt. Electrolysis was continued using cathode 2 for ten days.

It is to be understood that although the invention has been described with specific reference to particular embodiments thereof, it is not to be so limited since changes and alterations therein may be made which are within the full intended scope of this invention as defined by the appended claims.

We claim:

1. In a method of electrolyzing aqueous alkali metal chloride comprising passing an electrolytic current from an anode of an electrolytic cell through the alkali metal chloride electrolyte to a cathode, evolving chlorine at the anode, and evolving hydrogen at the cathode, the improvement wherein said cathode comprises a layer of an oxy-compound of a perovskite forming platinum group metal and an alkaline earth metal on an electroconductive substrate.

2. The method of claim 1 wherein the perovskite forming platinum group metal is chosen from the group consisting of osmium, ruthenium, and mixtures thereof.

3. The method of claim 1 wherein the alkaline earth metal is chosen from the group consisting of magnesium, calcium, strontium, barium, and mixtures thereof.

4. The method of claim 1 wherein the oxy-compound is chosen from the group consisting of magnesium ruthenate, magnesium ruthenite, calcium ruthenate, calcium ruthenite, strontium ruthenate, strontium ruthenite, barium ruthenate, barium ruthenite, and mixtures thereof.

5. The method of claim 4 wherein the oxy-compound of the perovskite forming platinum group metal and the alkaline earth metal is formed in situ on the surface of the cathode, and the cathode substrate has a layer of a material that is resistant to oxidation during the in situ formation of the oxy-compound.

6. The method of claim 5 wherein the cathode substrate has a layer of nickel beneath the layer of the oxy-compound of the perovskite forming platinum group metal and the alkaline earth metal.

7. The method of claim 1 wherein the alkali metal chloride is sodium chloride.

8. In a method of electrolyzing aqueous alkali metal chloride comprising passing an electrolytic current from an anode of an electrolytic cell through the alkali metal chloride electrolyte to an iron cathode, evolving chlorine at the anode, and evolving hydrogen at the iron cathode at a hydrogen evolution overvoltage above about 0.25 volt at a current density of 100 amperes per square foot, the improvement comprises reducing the hydrogen evolution overvoltage of the cathode by providing a layer of an oxy-compound of a platinum group metal and an alkaline earth metal on the iron cathode.

9. The method of claim 8 wherein the platinum group metal is a perovskite forming platinum group metal chosen from the group consisting of osmium, ruthenium, and mixtures thereof.

10. The method of claim 8 wherein the alkaline earth metal is chosen from the group consisting of calcium, strontium, barium, and mixtures thereof.

11. The method of claim 8 wherein the oxy-compound is chosen from the group consisting of calcium ruthenate, calcium ruthenite, strontium ruthenate, strontium ruthenite, barium ruthenate, barium ruthenite, and mixtures thereof.

12. The method of claim 11 wherein the oxy-compound of the perovskite forming platinum group metal and the alkaline earth metal is formed in situ on the surface of the cathode, and the cathode substrate has a layer of a material that is resistant to oxidation during the in situ formation of the oxy-compound.

13. The method of claim 12 wherein the cathode substrate has a layer of nickel beneath the layer of the oxy-compound of the perovskite forming platinum group metal and the alkaline earth metal.

14. The method of claim 8 wherein the alkali metal chloride is sodium chloride.

* * * * *